US005791360A

United States Patent [19]

Battiston et al.

[11] Patent Number: 5,791,360

[45] Date of Patent: Aug. 11, 1998

[54] STABLE TUBULAR CRUTCH WITH ADJUSTABLE HAND GRIP

[75] Inventors: Joseph Battiston; David Battiston, both of Chester, Va.

[73] Assignee: Tubular Fabricators Industry, Inc., Petersburg, Va.

[21] Appl. No.: 482,644

[22] Filed: Jun. 7, 1995

Related U.S. Application Data

[63] Continuation of Ser. No. 976,546, Nov. 16, 1992, abandoned.

[51] Int. Cl.[6] ..... A61H 3/02

[52] U.S. Cl. ..... 135/68; 135/72; 403/100

[58] Field of Search ..... 135/65, 66, 68, 135/71, 72, 73, 69; 403/100; 248/155.4

[56] References Cited

U.S. PATENT DOCUMENTS

| | | | |
|---|---|---|---|
| 885,339 | 4/1908 | Hargrove | 135/72 |
| 987,497 | 3/1911 | Cassidy | 135/72 |
| 1,505,081 | 8/1924 | Arndt | 135/68 |
| 3,858,596 | 1/1975 | Thomas | 135/73 X |
| 4,476,885 | 10/1984 | Stein | 135/72 X |
| 4,721,125 | 1/1988 | Wang-Lee | 403/100 X |
| 4,776,361 | 10/1988 | Staton | 135/66 |
| 4,838,291 | 6/1989 | DiVito | 135/72 X |

FOREIGN PATENT DOCUMENTS

| | | | |
|---|---|---|---|
| 0112818 | 1/1918 | United Kingdom | 135/69 |
| 0677084 | 8/1952 | United Kingdom | 135/69 |
| 2098470 | 11/1982 | United Kingdom | 135/66 |

OTHER PUBLICATIONS

Product Literature –Sunrise Medical/Guardian (Brochure copyright 1990).

Product Literature –Carex Health Care Products (1995).

Product Literature –Lumex Inc.

*Primary Examiner*—Winnie S. Yip

*Attorney, Agent, or Firm*—Klauber & Jackson

[57] ABSTRACT

A stable tubular crutch having a continuous one piece body, with an adjustable hand grip and riveted underarm support. The crutch is made of a tubular member, bent to form an elongated, flattened, fully enclosed, ovate structure with parallel spaced apart sections, within which the adjustable hand grip is positioned. An end of the tubular member longitudinally extends from the ovate structure in line with the major axis thereof and an independently adjustable straight tubular leg is interfitted with the extending end by an adjustable connection. A tubular underarm support, is fitted within a contoured section of the tubular member and is riveted thereto for a fixed connection. The adjustable hand grip is a short tube with a closed end supporting an extending hook. The base of a Y-shaped plastic member, with integrated metal rod (extending out of the fork of the Y) is slidingly retained, with a spring loading, in the open end of the tube. The metal rod, of non-circular cross section, and the hook are adapted to fit within any of a plurality of holes in the parallel spaced apart section for adjustability of the hand grip. The fork of the Y is arc-shaped, to correspond to the curvature of the tube, and serves to stabilize the hand grip.

12 Claims, 2 Drawing Sheets

STABLE TUBULAR CRUTCH WITH ADJUSTABLE HAND GRIP

This Application is a Continuation of application Ser. No. 07/976,546, filed Nov. 16, 1992, now abandoned.

FIELD OF THE INVENTION

This invention relates to tubular crutches and particularly to tubular crutches with quick release adjustable hand grips.

BACKGROUND OF THE INVENTION

Crutches, utilized by persons having leg or foot impairment, have been traditionally made of bent wood or more recently, of light weight, high strength, bent metal tubing. These crutches have generally been comprised of various interfitted components which are fixedly connected with one another to achieve a degree of rigidity and stability required in supporting the user's weight in motion, and at various angles of use during such motion. The rigid connections have usually been effected by bolts with wing nuts, for adjustability, or with non-adjustable rivets. In most of such crutches the user's weight is transferred from the initial supporting body, situated at the user's underarms, to a separate adjustable or telescoping supporting leg. The entire weight is thus placed on the bolts which provide the interconnection between the supporting body and the supporting leg. The weak points of the crutch are these connection points which form part of the weight supporting body of the crutch. Metal fatigue and bolt shear, with crutch failure, is possible after continued use, particularly by a heavy user.

A typical crutch (both wooden and metal tubular) comprises four separate elements in the construction of the weight supporting body. These elements include two lateral bent members (crutch bows) and a straight crutch leg which is sandwiched between them. The upper ends of the lateral bent members are fitted into recesses within an underarm rest to complete the body construction. A hand grip or support is adjustably connected to the lateral bent members to complete the crutch structure. Most of such hand grips are comprised of solid members with cores through which a bolt and wing nut connection is effected. Adjustment requires removal of the bolt and wing nut and is time consuming.

Single piece crutches, of the shepherd's crook type, with cantilevered underarm rests and cantilevered hand grips are not susceptible to these weak point connection areas. These crutches however suffer in areas of stability and comfortable use. The user must constantly maintain alignment of the crutch leg and underarm position to avoid use instability.

BRIEF DESCRIPTION OF THE INVENTION

It is an object of the present invention to provide a stable tubular crutch with a unitary body structure.

It is a further object of the present invention to provide a non-rotating, quickly adjustable, hand grip for tubular crutches.

It is a still further object of the present invention to provide such hand grip which is capable of being adjustably installed at inclines, for customized user comfort.

These and other objects, features and advantages of the present invention will become more evident from the following discussion and drawings in which:

DETAILED DESCRIPTION OF THE INVENTION

Figure 3:
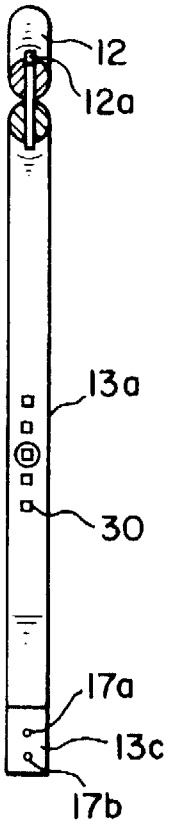
FIG. 3 is a cross sectional view taken along line 3—3 of FIG. 2.

Generally the present invention comprises a stable tubular crutch having a continuous one piece body comprised of a tubular member, bent to form an elongated flattened fully enclosed ovate structure with parallel spaced apart sections. An end of the tubular member longitudinally extends from the ovate structure substantially in line with the major axis thereof. Slight deviations from the axis line of up to about ½" (1.27 cm) are possible, without affecting stability. The user's weight is accordingly directly transmitted to the leg base of the crutch without intermediate weight supporting connecting elements such as bolts or rivets. The enclosed ovate structure provides full crutch stability.

The tubular member is fastened to itself in the formation of the enclosed ovate body structure. Preferably, one end of the tubular member is fully compressed and contoured to an extent sufficient for it to be fittingly engaged with the curvature of the tube to which it is fastened. Such fastening is preferably effected by rivets at a single connection location. Since this connection is lateral to the weight supporting axis and longitudinally extending leg, only a small portion of the user's weight is supported by this fastening and the connection is not overly subjected to stress.

To effect height adjustment, it is preferred that an independently adjustable straight tubular leg be interfitted with the extending end by an adjustable connection. The adjustable connection preferably comprises a double detent button structure with one of the tubular leg and extending end being provided with two spring loaded buttons which fit into corresponding holes of the other, at various locations, for rapid height adjustments. These buttons are solid or partially hollowed metal extensions, which, because of their unthreaded configuration are not as subject to stress and shear as are bolts and hollow rivets.

In accordance with a preferred embodiment of the present invention, a separate tubular underarm support, is fitted within a contoured, partially compressed section of the tube of the tubular member and is riveted thereto for a fixed connection. The separate underarm support does not however form part of the crutch body. The underarm support is preferably riveted to the tubular member at a point along the major axis of the ovate structure whereby stress placed thereon is minimized. Alternatively, a minor end of the ovate structure, opposite the extending end, can be appropriately deformed into an integral underarm support, provided that the tubing is capable of being sharply bent.

The parallel, spaced apart sections of the ovate structure of tubular crutches, whether of one piece or of prior art multiple piece construction, provide the axial support for the user's body and also support a hand grip positioned therebetween and adjustably fastened thereto. In accordance with a further aspect of the present invention, a readily adjustable hand grip, for use with a tubular crutch including the one piece crutch described above, comprises a spring loaded tubular member. One side of the tubular member terminates in a short extending support element such as a short metallic rod, which is adapted to be slidingly inserted into any one of a series of apertures in the parallel sections. The other side of the tubular member terminates in a second extending support element adapted to be inserted into any one of a series of apertures in the other of the parallel sections. The apertures into which the first and second supporting elements are inserted may either be directly opposite each other, as with standard placement of hand grips, or they may be slightly offset from each other to permit the hand grip to be placed at an incline, as desired, for the comfort of the user. The second supporting element is provided with removal retarding means such as locking means, embodied therein to prevent accidental dislodgment of the hand grip.

In order to prevent undesired rotation of the hand grip, the rod element may be of non-circular cross-section to fit into corresponding non-circular apertures. Alternatively, or in addition to such rotation prevention means, a fixed yoke element with a tube engaging surface extends about either the first or second extension elements into non-rotatable engagement with the adjacent tubular parallel section.

In a preferred embodiment, the adjustable hand grip is a short tube with one end supporting an extending hook. The base of a yoke element such as a Y-shaped plastic member, with integrated metal rod (extending out of the fork of the Y) is slidingly retained, with a spring loading, in the other end of the tube. The metal rod, of non-circular cross section (to prevent rotation), and the hook are adapted to fit within any of a plurality of holes in the parallel spaced apart sections for adjustability of the hand grip. The fork of the Y is arc-shaped, to correspond to the curvature of the tube, whereby it further stabilizes the hand grip against rotation.

DETAILED DESCRIPTION OF THE DRAWINGS AND PREFERRED EMBODIMENT

Figure 1:
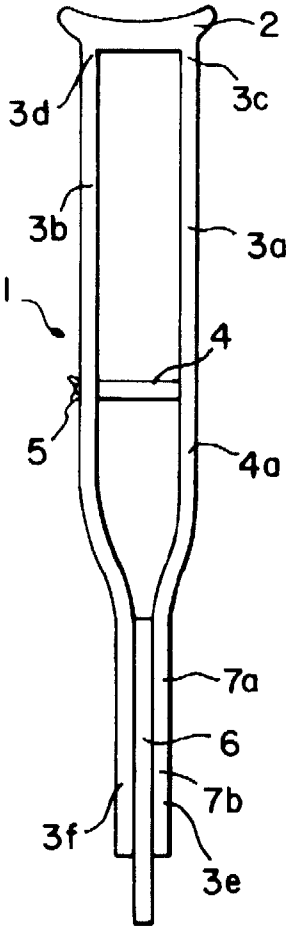
FIG. 1 PRIOR ART
FIG. 1 is a front view of a typical prior art crutch.

With specific reference to the drawings, in FIG. 1 a typical prior art crutch 1 is shown with the parts thereof which comprise weight supporting crutch body 1*a*. These separate parts include right and left bent tubes 3*a* and 3*b*, and underarm support 2, fitted onto ends 3*c* and 3*d* respectively of tubes 3*a* and 3*b*. The other ends, 3*e* and 3*f* respectively of bent tubes 3*a* and 3*b*, sandwich adjustable leg member 6, therebetween and are fixedly connected to the adjustable leg member 6 by adjustable connection members 7*a* and 7*b*, shown in phantom with dashed lines. Hand grip 4, with a through aperture, is adjustably connected to right and left bent tubes 3*a* and 3*b*. Right and left bent tubes 3*a* and 3*b* are correspondingly through-apertured at various adjustable heights for insertion of a bolt (not shown) through all of tubes 3*a*, 3*b* and hand grip 4. The bolt is fastened in place by wing nut 5. Height adjustment is effected by unthreading of the wing nut 5, removal of the bolt, movement and realignment of the hand grip 4 with the appropriate height apertures in tubes 3*a* and 3*b* and redeployment of the bolt therethrough and rethreading of wing nut 5 on the extending end of the bolt.

In use, the user places weight on underarm support 2. This weight is transmitted to leg 6 via tube members 3*a* and 3*b*. All of the transmitted weight is supported by connectors 7*a* and 7*b* at their point of intersection between leg 6 and tube members 3*a* and 3*b*.

Figure 2A:
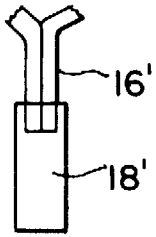
FIG. 2*a* is an alternative construction of the leg portion of the crutch of FIG. 2.
Figure 2:
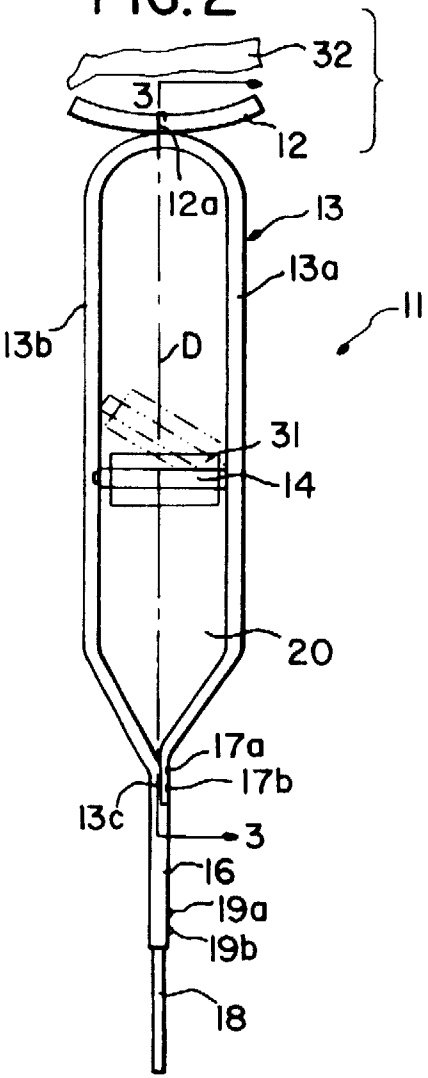
FIG. 2 is a front view of the crutch of the present invention.

The weight supporting body 13 of crutch 11 of the present invention, shown in FIG. 2, is comprised of a single tubular member bent into a closed ovate structure 20 with spaced parallel sides 13*a* and 13*b*. An underarm support 12 would be fitted with a sleeve or pad 32 to provide conforming to the user. Side 13*b* unitarily continues beyond the periphery of the ovate structure into extension leg element 16. Extension element 16 is substantially in line with major axis D of ovate structure 20. End 13*c* of the tubular member is compressed together, while maintaining its original curvature whereby it is fitted on extension element 16 and riveted thereto by rivets 17*a* and 17*b*. Adjustable leg 18 of smaller diameter than the extension element 16 is fitted therewithin and is adjustably held by button elements 19*a* and 19*b*, which extend through corresponding apertures in extension element 16.

In an alternate construction, as shown in FIG. 2*a*, extension element 16' can be comprised of abutted hemispherical ends of parallel sides 13*a* and 13*b*. In this embodiment leg element 18' is of larger diameter than extension element 16' and is fitted over the extension element.

Underarm support 12 is a separate element, which, as shown more clearly in FIG. 3, is fitted into a partial compression of the tubular member and riveted thereto by rivet 12*a*. Rivet 12*a* is preferably in line with major axis D (with the weight vector passing downward through this axis) whereby peripheral weight shearing stress is minimized.

Figure 4:
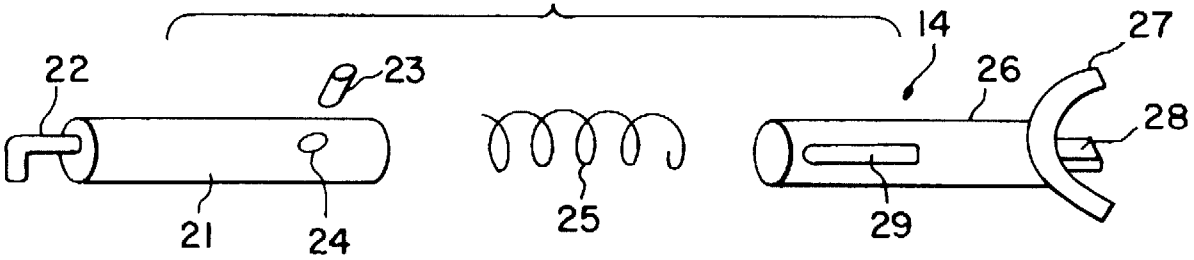
FIG. 4 is an exploded view of the adjustable hand grip of the present invention.

The adjustable hand grip 14 of the present invention, as more clearly seen in the exploded view of FIG. 4, is comprised of tubular member 21 having a closed end which supports hook element 22. Spring 25 is inserted into tubular member 21 and plastic Y-shaped member 26 is inserted into tubular member 21 to compress spring 25. Rivet 23 fits within aperture 24 (and corresponding exit aperture (not shown) of tubular member 21. Rivet 23 also engages slot 29 of Y-shaped member 26, whereby it is retained within tubular member 21 with a spring loading. Compression of the Y-shaped member 26 cause the rivet 23 to move within slot 29 to shorten the length of the hand grip 14.

As shown in FIG. 3, parallel side 13*a* comprises a series of spaced apart square apertures 30. Parallel side 13*b* has corresponding apertures (not shown).

The hand grip 14 is adjustably positioned by hooking hook 22 through a selected aperture in either of parallel sides 13*a* or 13*b* with the hook extending along the length of the tube (the curvature of the tube may interfere with a lateral placement of the hook). Y-shaped member 26 is compressed into tubular member 21, while extension rod 28, of square cross-section, is fitted into the appropriate and correspondingly shaped aperture 30. Curved section 27 (the fork of the Y) fittingly engages the curvature of parallel side 13*a* to help guide extension rod 28 into engagement with the aperture 30. In addition, curved section 27 helps maintain the hand grip 14 in non-rotatable engagement with the crutch body 13.

Positioning of the hand grip 14 is shown in standard hand grip position and with dotted lines (31) in inclined position for user comfort as desired. In the latter position the rod 28 and hook 22 are engaged with opposing but offset apertures. The Y-shaped member 26 is preferably comprised of a smooth hard plastic to facilitate its movement within the tubular member 21 and to prevent nicking or marring of the tubular surface.

It is understood that the above description and drawings are illustrative of the present invention and details contained therein are not to be construed as limitations on the present invention. Changes in components and structure may be made without departing from the scope of the present invention as defined in the following claims.

For example, the crutch assembly and components of the invention may be fabricated entirely out of plastics materials by conventional fabrication techniques such as injection molding, hot stamping and the like. Accordingly, the invention is considered to contemplate this aspect within its initial spirit and scope.

What is claimed is:

1. A stable tubular crutch having a continuous one piece body comprised of a tubular member, bent to form an elongated flattened fully enclosed ovate structure with parallel spaced apart sections; said ovate structure having a major axis; wherein an end of the tubular member longitudinally extends from the ovate structure, substantially in line with the major axis of the ovate structure, with said longitudinal extending end comprising a leg of the crutch, wherein the parallel, spaced apart sections of the ovate structure has a hand grip which is positioned therebetween the parallel spaced apart sections and adjustable fastened thereto, said hand grip comprising a tubular member having one end which supports an outwardly extending hook element; said hand grip further comprising a spring member contained within the tubular member and a Y-shaped member movably contained within the tubular member at an other end of said tubular member and compressing said spring, with the base of the Y-shaped member being contained within said tubular member and a fork of the Y-shaped member extending from the tubular member, and wherein a rod extends from the fork of the Y; wherein said parallel sections of the ovate structure each comprises a series of spaced apart non-circular apertures facing each other and in alignment with each other, each of said apertures being of a cross section corresponding to the cross section of the rod; wherein the hand grip is positioned between the parallel sections by hooking the hook through a selected aperture in one of the parallel sections, and compressing the Y-shaped member into the other end of the tubular member against the spring, while fitting the extension rod into the appropriate and correspondingly shaped aperture in the other of the parallel sections, with the fork being biased by said spring thereby fitted into engagement with the other of the parallel sections.

2. The tubular crutch of claim 1 wherein the tubular member is fastened to itself in the formation of the enclosed ovate body structure.

3. The tubular crutch of claim 2, wherein one end of the tubular member is fully compressed and contoured to an extent sufficient for it to be fittingly engaged with the tube to which it is fastened.

4. The tubular crutch of claim 1, wherein an independently adjustable straight tubular leg is intermitted with the longitudinally extending end of said tubular member by an adjustable connection to form the leg of the crutch.

5. The tubular crutch of claim 4 wherein the adjustable connection comprises a double detent button structure with one of the tubular leg and said longitudinally extending end of said tubular member being provided with two spring loaded buttons which fit into corresponding holes of the other of said tubular leg and said longitudinally extending end, at various locations, for rapid height adjustments.

6. The tubular crutch of claim 1, wherein a separate tubular underarm support, is fitted within a contoured, partially compressed section of the ovate structure of the tubular member and is riveted thereto for a fixed connection at a point along the major axis of the ovate structure whereby stress placed thereon is minimized.

7. The tubular crutch of claim 1, wherein, a minor end of the ovate structure, opposite the longitudinal extending is deformed into an integral underarm support.

8. A height adjustable hand grip for use with a tubular crutch having tubular, parallel, spaced apart sections in an ovate structure, with said hand grip being adapted for positioning between the parallel sections and for being adjustably fastened thereto, said hand grip comprising:

a tubular member having first and second free ends;

wherein the first end of the tubular member terminates in a first extending support element, adapted to be slidingly inserted into any one of a series of apertures in the parallel sections of said ovate structure, wherein said first extending support element comprises a Y-shaped member movably contained within the tubular member, with the base of the Y-shaped member being contained within said tubular member and a fork of the Y-shaped member extending from the tubular member, and wherein a rod extends from the fork of the Y-shaped member; said rod having a cross section adapted to correspond the cross section of the aperture of the parallel sections.

wherein the second end of the tubular member terminates in a second extending support element comprising an outwardly extending hook element adapted to be inserted into any one of a series of apertures in the other of the parallel sections, said hook element serving to prevent accidental dislodgment of the hand grip from the parallel sections of the crutch;

the tubular member having spring loading means therein, which permit compression of the first and second extending support elements toward each other, to permit one of the first or second extending support element to be positioned for insertion into one of the aperture, after the insertion of the other of extending support elements in a different aperture, and whereby the spring loading means maintains the first and second extending support elements in the apertures into which they are inserted respectively, said spring loading means comprising a spring member contained within the tubular member;

wherein the hand grip is adapted to be adjustably positioned between the parallel sections by hooking the hook through a selected aperture in one of the parallel sections and compressing the Y-shaped member into the other end of the tubular member against the spring, while fitting the extension rod into the appropriate and correspondingly shaped aperture in the other one of the parallel sections, with the fork being biased by said spring thereby fitted into engagement with the other of the parallel sections.

9. The adjustable hand grip of claim 8, wherein the rod comprises a metal rod.

10. The adjustable hand grip of claim 9, wherein the metal rod comprises a non-circular cross section.

11. The adjustable hand grip of claim 8, wherein said hand grip further comprises engagement mean adapted to engage the curvature of either of the parallel section whereby the engagement means prevents rotation of the hand grip relative to the parallel sections.

12. The adjustable hand grip of claim 8, wherein the rod and hook are adapted to be engaged with apertures in the parallel section which oppose and are offset from each other.

* * * * *